US012678659B2

(12) United States Patent
Singh et al.

(10) Patent No.: US 12,678,659 B2
(45) Date of Patent: Jul. 14, 2026

(54) REFORMER EXERCISE APPARATUS

(71) Applicant: Balanced Body, Inc., Sacramento, CA (US)

(72) Inventors: Harbir Singh, Roseville, CA (US); Yunhui Liu, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 71 days.

(21) Appl. No.: 18/824,148

(22) Filed: Sep. 4, 2024

(65) Prior Publication Data

US 2026/0061245 A1 Mar. 5, 2026

(51) Int. Cl.
*A63B 22/00* (2006.01)
*A63B 21/00* (2006.01)
*A63B 21/04* (2006.01)

(52) U.S. Cl.
CPC ..... *A63B 22/0087* (2013.01); *A63B 21/0428* (2013.01); *A63B 21/4031* (2015.10); *A63B 21/4034* (2015.10); *A63B 2225/093* (2013.01)

(58) Field of Classification Search
None
See application file for complete search history.

(56) References Cited

U.S. PATENT DOCUMENTS 4,892,090 A * 1/1990 Kaeser ..... A61H 15/0078 601/99
6,186,929 B1 * 2/2001 Endelman ..... A63B 21/154 482/121
7,833,139 B1 11/2010 Endelman et al.
8,721,511 B2 5/2014 Endelman et al.
11,065,495 B1 * 7/2021 Savarino ..... A63B 21/023
11,420,087 B2 * 8/2022 Aronson ..... A63B 21/00069
2003/0132614 A1 * 7/2003 Kreamer ..... A63B 23/16 280/647
2004/0176227 A1 * 9/2004 Endelman ..... A63B 22/203 482/142
2006/0046914 A1 * 3/2006 Endelman ..... A63B 23/03525 482/148

(Continued)

FOREIGN PATENT DOCUMENTS

AU 2003248313 C1 * 10/2003 ..... A63B 22/0087
BR 102017013235 A2 * 10/2017 ..... A63B 21/055

(Continued)

*Primary Examiner* — Shila Jalalzadeh Abyaneh
(74) *Attorney, Agent, or Firm* — Greenberg Traurig, LLP; John R. Wahl

(57) ABSTRACT

A reformer exercise apparatus includes a frame having a head end member, a foot end member and a pair of parallel track members spacing the head end member from the foot end member of the frame, a carriage on the frame configured for movement back and forth between the head end member and the foot end member on the parallel track members, and one or more bias members fastened between the carriage and the foot end member of the frame for biasing the carriage toward the foot end member on the parallel track members The reformer has two spaced apart arm cord riser support tubes fastened to the head end member and an inverted U shaped trapeze tower fastened to the two spaced apart arm cord riser support tubes rather than the trapeze tower being directly fastened to the head end member the frame.

8 Claims, 4 Drawing Sheets

(56) References Cited

U.S. PATENT DOCUMENTS

| | | | | |
|---|---|---|---|---|
| 2008/0248935 | A1* | 10/2008 | Solow | A63B 21/154 482/142 |
| 2009/0270235 | A1* | 10/2009 | Solow | A63B 21/1609 482/142 |
| 2010/0323857 | A1* | 12/2010 | D'Silva | A63B 22/0007 482/121 |
| 2013/0017935 | A1* | 1/2013 | Endelman | A63B 21/156 482/131 |
| 2013/0210593 | A1* | 8/2013 | Mcbride | A63B 23/1218 482/142 |
| 2014/0141948 | A1* | 5/2014 | Aronson | A63B 22/0087 482/128 |
| 2015/0065320 | A1* | 3/2015 | Anderson | A63B 21/156 482/142 |
| 2018/0169464 | A1* | 6/2018 | Janowski | A63B 21/0552 |
| 2021/0244993 | A1* | 8/2021 | Singer | A63B 5/11 |

FOREIGN PATENT DOCUMENTS

| | | | | |
|---|---|---|---|---|
| WO | WO-2023160134 | A1 * | 8/2023 | A63B 22/203 |
| WO | WO-2024074740 | A1 * | 4/2024 | A63B 21/151 |

* cited by examiner

REFORMER EXERCISE APPARATUS

BACKGROUND OF THE DISCLOSURE

Field of the Disclosure

The present disclosure relates to an exercise apparatus used in Pilates type exercises. In particular, this disclosure relates to a reformer exercise apparatus including a novel tower assembly or a novel foot bar locking mechanism.

State of the Art

Exercise machines utilized in the performance of physical exercises originated by Joseph Pilates typically are often performed on a stationary apparatus called a reformer. A reformer typically has a rectangular wood or metal frame having a foot end and a head end. A pair of parallel side rails separates the head and foot ends. A rolling carriage is configured to roll along between the side rails from the foot end to the head end and is biased toward the foot end of the frame by one or more coil springs connected to an anchor bar fastened to the frame near the foot end and to the carriage. A foot bar is fastened to the foot end of the frame. A user typically sits or reclines on the carriage and pushes against the foot bar to move the carriage away from the foot end of the frame against spring tension during exercise. In some reformers, a trapeze tower is attached to the head end of the frame to provide additional anchor points for springs and trapeze bars to facilitate further alternative exercises when a user stands or sits upon the carriage or an upper surface of the reformer. Such towers are bolted or otherwise fixed to the frame of the reformer.

Some reformers have foot bar support members fastened to brackets mounted to the reformer frame below the side rails to support the foot bar at various arcuate positions above the foot end of the frame. Such support members typically fit into one of a series of notches or slots in the foot bar support brackets to fix the foot bar at a particular height above the side rails of the frame.

When a reformer is not being used, it would be advantageous if it could be readily stored in a compact fashion. However, reformers are about 7 feet long and 24-30 inches wide, and relatively heavy, and thus awkward to store conveniently. Add to that having a trapeze tower fastened to the head end of the frame creates another obstacle to storing the reformer in a readily accessible manner. Innovations in accordance with the present disclosure address aspects of these limitations.

SUMMARY OF THE DISCLOSURE

A reformer exercise apparatus in accordance with the present disclosure includes a generally rectangular frame, a carriage on the frame configured for movement back and forth between a head end and a foot end of the frame on parallel tracks, one or more bias members fastened between the carriage and an anchor bar carried at the foot end of the frame for biasing the carriage toward the foot end of the frame on the parallel tracks, and a foot bar fastened to a foot end of the frame.

One exemplary exercise apparatus in accordance with the present disclosure preferably includes a frame having a head end member, a foot end member and a pair of parallel track members spacing the head end member from the foot end member of the frame, a carriage on the frame configured for movement back and forth between the head end member and the foot end member on the parallel track members, and one or more bias members fastened between the carriage and the foot end member of the frame for biasing the carriage toward the foot end member on the parallel track members The reformer has two spaced apart arm cord riser support tubes fastened to the head end member and an inverted U shaped trapeze tower fastened to the two spaced apart arm cord riser support tubes rather than the trapeze tower being directly fastened to the head end member the frame.

More particularly the head end member includes an elongated die cast body having a straight mid portion and opposite curved end portions. The elongated die cast body has a trapezoidal cross sectional outer shape with upright outer and inner walls that merge into a flat top wall. This die cast body also has a vertical through bores inwardly adjacent each curved end portion. These two through bores are adjacent to and between the mid and curved end portions. One through bore is formed adjacent to and between the straight mid portion and one of the opposite curved end portions and a second one is formed adjacent to and between the straight mid portion and the other of the opposite curved end portions. The head end member also has a flat metal bottom plate fastened to the underside of the elongated die cast metal body. This metal bottom plate is fixed to the two spaced apart arm cord riser support tubes and each arm cord riser support tube extends through one of the through bores in the elongated die cast metal body when the metal bottom plate is fastened to the bottom or underside of the elongated die cast metal body. Preferably each of the two spaced apart arm cord riser support tubes is welded to the metal bottom plate. The inverted U shaped trapeze tower has opposite ends each of which is removably fastened to one of the two spaced apart arm cord riser support tubes via a split clamshell clamp.

One embodiment of a reformer in accordance with the present disclosure may be viewed as including a frame having a head end member, a foot end member and a pair of parallel track members spacing the head end member from the foot end member of the frame, a carriage on the frame configured for movement back and forth between the head end member and the foot end member on the parallel track members, and one or more bias members fastened between the carriage and the foot end member of the frame for biasing the carriage toward the foot end member on the parallel track members. The reformer has a foot bar attached to the frame adjacent the foot end member and configured to be positioned at selectable heights from the foot end member. A foot bar support bracket is fastened to each of the parallel track members adjacent the foot end member. Each foot bar support bracket has a plurality of recesses for receiving a rod fastened to one end of a support link connected to the foot bar. This rod extends between the parallel track members and each foot bar support bracket and may be selectively positioned in corresponding recesses to position the foot bar at one of the selectable heights. The foot bar assembly also includes a locking sleeve slidably mounted on the rod, and a locking feature fastened to the foot bar support bracket configured to engage the locking sleeve when the rod is inserted into a predetermined recess so as to retain the rod within the predetermined recess. This locking feature may include a plate with a C shaped recess sized to receive and retain the locking sleeve within the C shaped recess.

DETAILED DESCRIPTION

Figure 1:
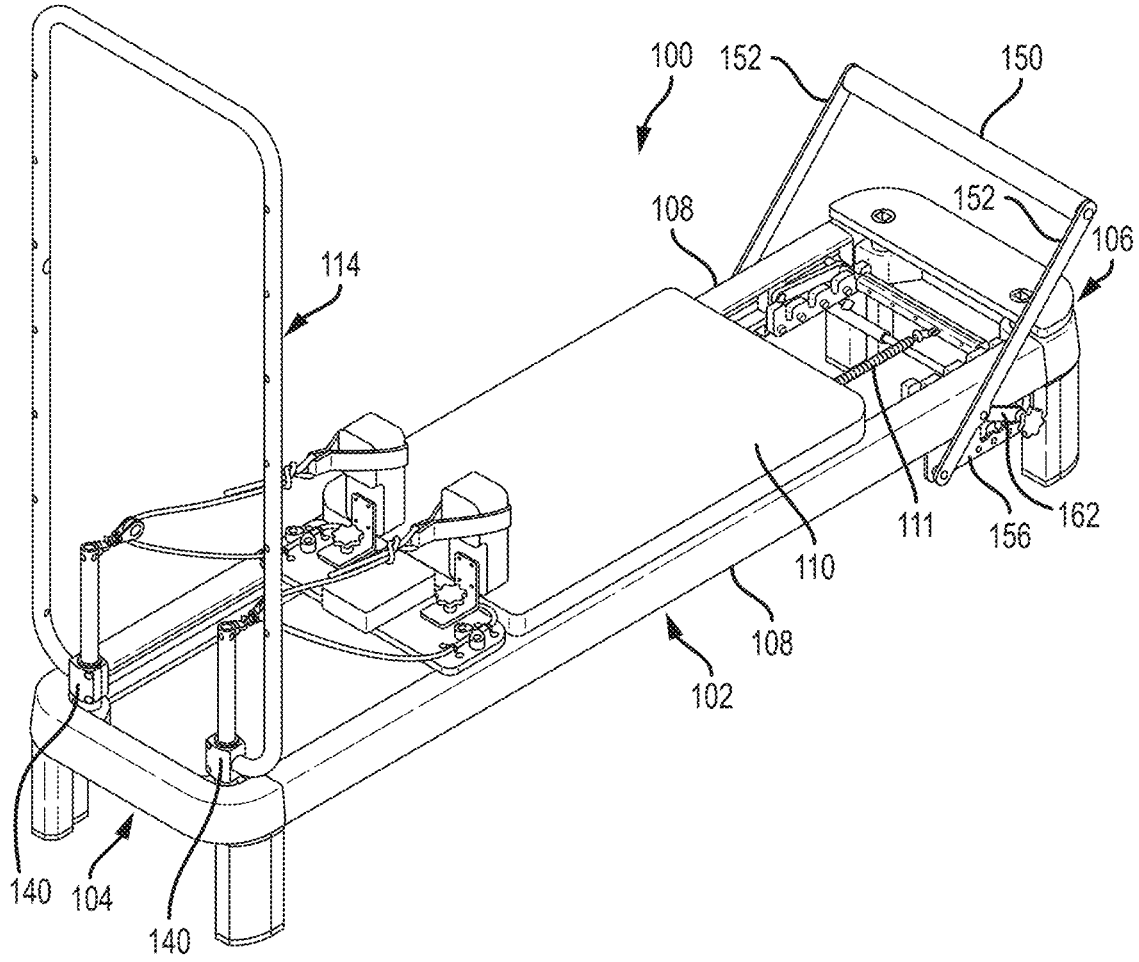
FIG. 1 is a perspective view of a reformer exercise apparatus having a trapeze tower in accordance with the present disclosure.

An exemplary embodiment of a reformer exercise apparatus 100 in accordance with the present disclosure is shown in a perspective view in FIG. 1. The reformer 100 includes a frame 102 having a head end member 104, a foot end member 106 and a pair of parallel track members 108 spacing the head end member 104 from the foot end member 106 of the frame 102. A carriage 110 on the frame 102 is configured for movement back and forth between the head end member 104 and the foot end member 106 on the parallel track members 108. One or more bias members 111 is fastened between the carriage 110 and the foot end member 106 of the frame 102 for resiliently biasing the carriage 110 toward the foot end member 106 on the parallel track members 108.

Figure 2:
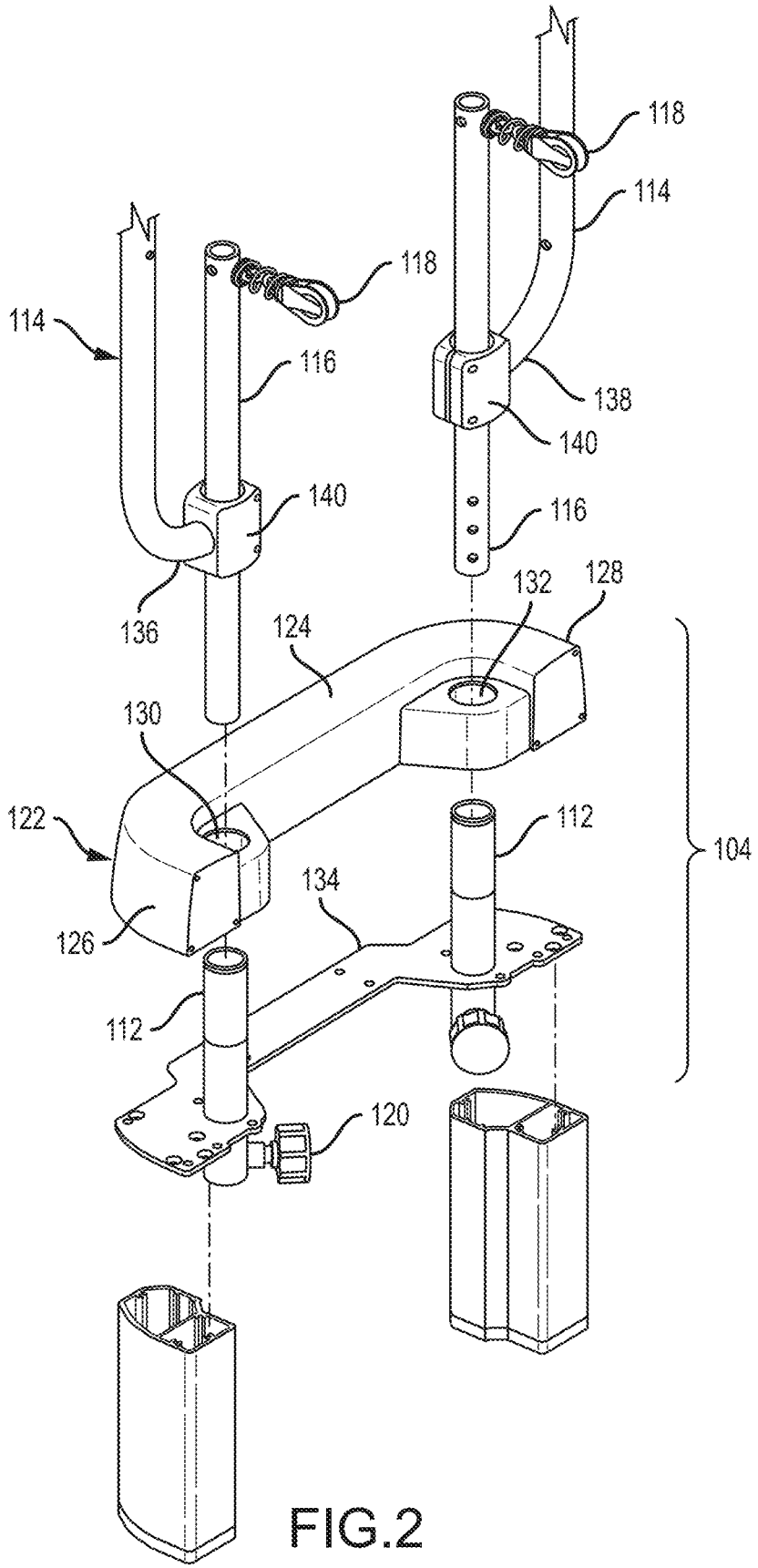
FIG. 2 is an exploded view of the head end portion of the reformer shown in FIG. 1.
Figure 3:
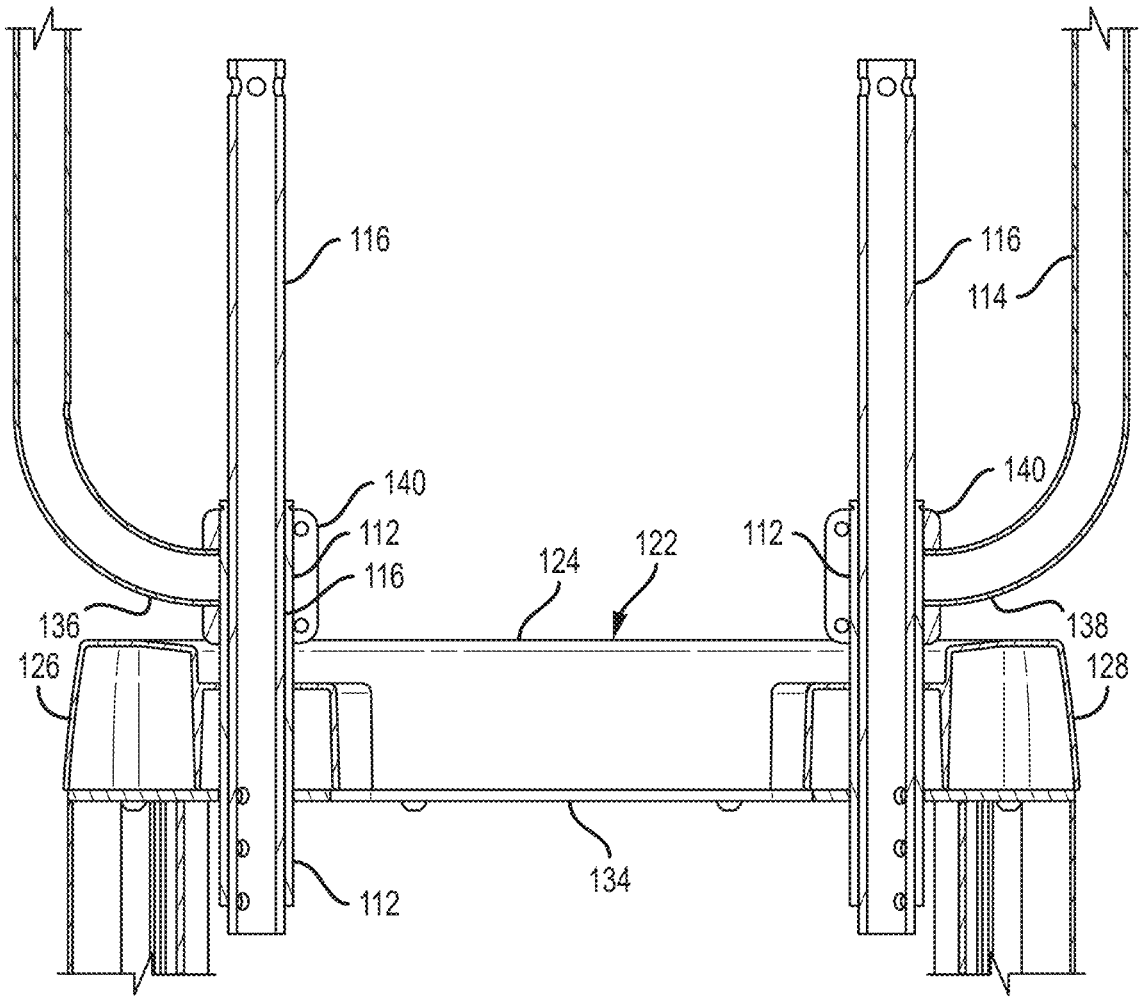
FIG. 3 is. A vertical cross sectional view through the head end of the reformer shown in FIG. 1.

Two spaced apart arm cord riser support tubes 112 are fastened to the head end member 104. Each of these arm cord riser support tubes 112 can best be seen in the exploded view shown in FIG. 2 and the vertical sectional view of FIG. 3. An inverted U shaped trapeze tower 114 is removably fastened to the two spaced apart arm cord riser support tubes 112. This inverted U shaped trapeze tower 114 carries a series of eye hook mounting points around its perimeter for mounting springs and a trapeze bar (not shown) for utilization during various Pilates exercise routines by a user either standing next to the reformer 100 or positioned on the carriage 110. An arm cord riser tube 116 having a pulley 118 fastened to a distal end thereof is telescopically supported in each of the riser support tubes 112. Each of the arm cord riser tubes 116 may be adjustably secured in the arm cord riser support tubes 112 at selectable heights above the head end member 104 via a screw knob 120 threaded into the lower end portion of each of the riser support tubes 112.

The head end member 104 comprises an elongated die cast metal body 122 that may have a partial rectangular or trapezoidal cross sectional outer shape with upright outer and inner walls that merge into a flat top wall. This die cast body 122 is preferably made of aluminum and also has a vertical through bore inwardly adjacent each curved end portion each sized to receive and support one of the arm cord riser support tubes 112. These two through bores are adjacent to and between the mid and curved end portions as clearly shown in FIGS. 1-3.

More particularly, the die cast body 122 has a straight mid portion 124 and opposite curved end portions 126 and 128. The die cast body 122 has two spaced vertical through bores 130 and 132. One through bore 130 is formed adjacent to and between the straight mid portion 124 and one of the opposite curved end portions 126 and a second through bore 132 is formed adjacent to and between the straight mid portion 124 and the opposite curved end portion 128. The head end member 104 further includes a flat metal bottom plate 134 fastened to the elongated die cast body 122. This metal bottom plate 134 is permanently fixed to and rigidly supports the two spaced apart arm cord riser support tubes 112. Each of the two spaced apart arm cord riser support tubes 112 is preferably welded to the metal bottom plate 134. Each arm cord riser support tube 112 extends through one of the vertical through bores 126 or 128 in the elongated die cast metal body 122 when the metal bottom plate 134 is fastened to the die cast metal body 122.

The inverted U shaped trapeze tower 114 has opposite ends 136 and 138 each of which is removably fastened to one of the two spaced apart arm cord riser support tubes 112 via a split clamshell clamp 140. This mounting arrangement permits the arm cord riser tubes 116 to each independently be raised and lowered within its support tube 112 and locked in position via threaded knobs 120 and independent of the positioning of the trapeze tower structure 114 on the head end of member 104.

One embodiment of an exemplary reformer 100 in accordance with the present disclosure also has a foot bar 150 attached to the frame 102 adjacent the foot end member 106 and configured to be positioned at selectable heights from the foot end member 106. This foot bar 150 has a straight padded bar portion supported by two legs 152 each extending from the padded foot bar portion 150 to a pivot joint 154 on a foot bar support bracket 156 fastened to each of the parallel track members 108 adjacent the foot end member 106 and which supports this foot bar 150. Each foot bar support bracket 156 carries a plurality of longitudinally spaced recesses 158 for receiving a rod 160 fastened to one end of a support link 162 connected to each of the foot bar legs 152. This rod 160 extends between the parallel track members 108 parallel to the foot bar 150 and between each foot bar support bracket 156 and may be selectively positioned in corresponding recesses 158 in each of the foot bar support brackets 156 to position the foot bar 150 at one of the selectable heights.

Figure 4:
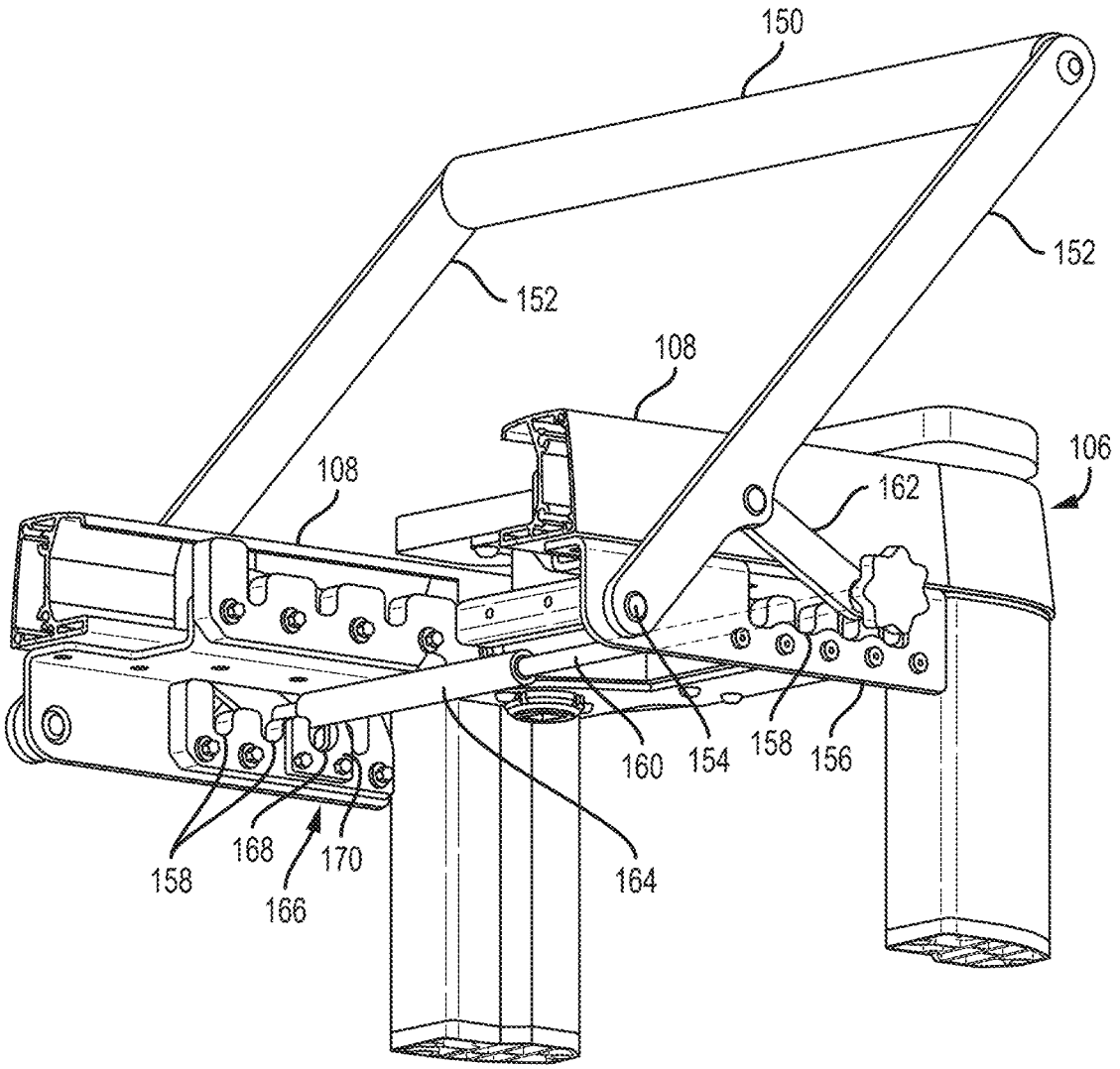
FIG. 4 is partial perspective view of the foot end portion of the reformer shown in FIG. 1.

A locking sleeve 164 is slidably mounted on the rod 160. See FIG. 4. The foot bar support bracket 156 preferably also includes a locking feature 166 fastened to the foot bar support bracket 156 that is configured to engage the locking sleeve 164 when the rod 160 is inserted into a predetermined recess 158 in the locking feature 166 attached to the foot bar support bracket 156 so as to retain the rod 160 within the predetermined recess.

This locking feature 166 may be a plate 170 fastened to the foot bar support bracket 156 adjacent one particular recess 158 and which plate 170 has a C shaped recess 168 sized so as to receive and engage the locking sleeve 164 but not release the locking sleeve 164 when the rod 160 is attempted to be removed from that particular recess 158.

This locking feature 166 permits the reformer 100 to be stood upright on its foot end member 106 for storage. In such an upright position the foot bar 150, locked in position by the locking feature 166, in conjunction with the reformer foot end member 106 provides a stable vertical support base for the reformer 100.

Another advantage of the locking feature 166 described above permits a user to utilize the foot bar 150 in reverse, when it is locked in position, rather than simply pushing against it. That is, a user sitting or lying on the reformer carriage 110 can utilize the foot bar 150 as a fulcrum for exercises that would otherwise not be possible without the foot bar 150 being locked in place.

There are many alternative arrangements for the locking feature 166 that will be readily apparent to a person skilled in the art. For example, instead of a sleeve plate 170 with C shaped recess 168, a pin and socket, or hook and eye latch that retains the rod 160 in its slot 158 would achieve the same functionality.

Accordingly, all such alternatives, variations and modifications are intended to be encompassed within the scope of and as defined by the following claims.

What is claimed is:

1. A reformer exercise apparatus comprising:

a frame having a head end member, a foot end member and a pair of parallel track members spacing the head end member from the foot end member of the frame, wherein the head end member comprises an elongated die cast metal body having a straight mid portion and opposite curved end portions, the elongated die cast metal body having two spaced upright through bores, one through bore formed adjacent to and between the straight mid portion and one of the opposite curved end portions and a second one formed adjacent to and between the straight mid portion and another of the opposite curved end portions;

a carriage on the frame configured for movement back and forth between the head end member and the foot end member on the parallel track members;

one or more bias members fastened between the carriage and the foot end member of the frame for biasing the carriage toward the foot end member on the parallel track members;

two spaced apart arm cord riser support tubes each passing upward through one of the two spaced upright through bores, each riser support tube being fastened to a flat metal plate extending between and beneath the two spaced upright through bores and fixed to the elongated die cast metal body of the head end member; and an inverted U shaped trapeze tower fastened to the two spaced apart arm cord riser support tubes.

2. The reformer exercise apparatus according to claim 1 wherein each of the two spaced apart arm cord riser support tubes is welded to the flat metal plate.

3. The reformer exercise apparatus according to claim 1 wherein the inverted U shaped trapeze tower has opposite ends, each of which is removably fastened to one of the two spaced apart arm cord riser support tubes via a split clamshell clamp.

4. A reformer exercise apparatus comprising:

a frame having a head end member, a foot end member and a pair of parallel track members spacing the head end member from the foot end member of the frame, wherein the head end member comprises an elongated die cast metal body having a straight mid portion and opposite curved end portions, the elongated die cast metal body having two spaced upright through bores, one through bore formed adjacent to and between the straight mid portion and one of the opposite curved end portions and a second one formed adjacent to and between the straight mid portion and another of the opposite curved end portions, and two spaced apart arm cord riser support tubes each passing through one of the two spaced upright through bores, each riser support tube being fastened to a flat metal plate extending between and beneath the two spaced upright through bores and fixed to the elongated die cast metal body of the head end member;

a carriage on the frame configured for movement back and forth between the head end member and the foot end member on the parallel track members;

one or more bias members fastened between the carriage and the foot end member of the frame for biasing the carriage toward the foot end member on the parallel track members;

a foot bar attached to the frame adjacent the foot end member and configured to be positioned at selectable heights from the foot end member;

a foot bar support bracket fastened to each of the parallel track members adjacent the foot end member, wherein each foot bar support bracket has a plurality of recesses configured to receive a rod fastened to one end of a support link connected to the foot bar, wherein the rod extends between the parallel track members and each foot bar support bracket and is selectively positionable in corresponding recesses of the foot bar support brackets to position the foot bar at one of the selectable heights;

a round tubular locking sleeve slidably mounted on the rod; and a locking feature fastened to one of the foot bar support brackets and configured to engage the round tubular locking sleeve when the rod is inserted into a predetermined recess of said one of the foot bar support brackets so as to retain the rod within the predetermined recess.

5. The reformer exercise apparatus according to claim 4 wherein the locking feature is a plate with a C shaped recess sized to receive and retain the round tubular locking sleeve within the C shaped recess.

6. The reformer exercise apparatus according to claim 5 wherein the plate is fastened to said one of the foot bar support brackets.

7. A reformer exercise apparatus comprising:

a frame having a head end member, a foot end member and a pair of parallel track members spacing the head end member from the foot end member of the frame, wherein the head end member comprises an elongated die cast metal body having a straight mid portion and opposite curved end portions, the elongated die cast metal body having two spaced upright through bores, one through bore formed adjacent to and between the straight mid portion and one of the opposite curved end portions and a second one formed adjacent to and between the straight mid portion and another of the opposite curved end portions, two spaced apart arm cord riser support tubes each passing through one of the two spaced upright through bores, each riser support tube being fastened to a flat metal plate extending between and beneath the two spaced upright through bores and fixed to the elongated die cast metal body of the head end member;

a carriage on the frame configured for movement back and forth between the head end member and the foot end member on the parallel track members;

one or more bias members fastened between the carriage and the foot end member of the frame for biasing the carriage toward the foot end member on the parallel track members;

two spaced apart arm cord riser support tubes fastened to the head end member;

an inverted U shaped trapeze tower fastened to the two spaced apart arm cord riser support tubes;

a foot bar attached to the frame adjacent the foot end member and configured to be positioned at selectable heights from the foot end member;

a foot bar support bracket fastened to each of the parallel track members adjacent the foot end member, wherein each foot bar support bracket has a plurality of recesses configured to receive a cylindrical rod fastened to one end of a support link connected to the foot bar, wherein the cylindrical rod extends between the parallel track members and each foot bar support bracket and is selectively positionable in corresponding recesses of the foot bar support brackets to position the foot bar at one of the selectable heights;

a round tubular locking sleeve slidably mounted on the cylindrical rod; and a locking feature fastened to one of the foot bar support brackets and configured to engage the round tubular locking sleeve when the cylindrical rod is inserted into a predetermined recess of said one of the foot bar support brackets so as to retain the cylindrical rod within the predetermined recess.

8. The reformer exercise apparatus according to claim 7 wherein the locking feature is a plate fastened to said one of the foot bar support brackets, wherein the plate has a C shaped recess sized to receive and engage the round tubular locking sleeve but not release the round tubular locking sleeve when the cylindrical rod is attempted to be removed from the predetermined recess.

* * * * *